US005871184A

United States Patent [19]

Kaopio

[11] Patent Number: 5,871,184

[45] Date of Patent: Feb. 16, 1999

[54] HOLDER FOR A BABY BOTTLE

[76] Inventor: LeVaughn Kaopio, 7084 Kahuna Rd., Kapaa, Hi. 96746

[21] Appl. No.: 925,155

[22] Filed: Sep. 8, 1997

[51] Int. Cl.[6] ..... A47D 15/00

[52] U.S. Cl. ..... 248/102; 248/908

[58] Field of Search ..... 248/102, 103, 248/104, 105, 106; D24/199; D21/162; 215/11.1, 11.2, 11.3

[56] References Cited

U.S. PATENT DOCUMENTS

| | | | |
|---|---|---|---|
| D. 314,432 | 2/1991 | Shaw | D21/162 |
| D. 325,260 | 4/1992 | Goddard | D24/199 |
| D. 340,991 | 11/1993 | Clements | D21/199 |
| 2,409,820 | 10/1946 | Zimmern . | |
| 2,522,381 | 9/1950 | Kramer . | |
| 5,072,843 | 12/1991 | James | 248/102 X |
| 5,217,192 | 6/1993 | Oktayuren | 248/102 |
| 5,624,090 | 4/1997 | Gammelgaard | 248/102 |

*Primary Examiner*—Ramon O. Ramirez
*Attorney, Agent, or Firm*—Michael I. Kroll

[57] ABSTRACT

A holder (10) for a baby bottle (12) having a cap (14) with a nipple (16) extending therethrough. The holder (10) comprises an insulation jacket (18) having a central aperture (20) extending vertically therein. An outer sleeve (22) has an open top end (24) and closed bottom end (26) held within the central aperture (20). An inner sleeve (28) has an open top end (30) and a closed bottom end (32) held within the outer sleeve (22), to receive the baby bottle (12) therein, with the nipple (16) extending out therefrom. The insulation jacket (18) will protect the baby bottle (12) from breakage and will keep a beverage (34) within the baby bottle (12) at a desired temperature.

17 Claims, 3 Drawing Sheets

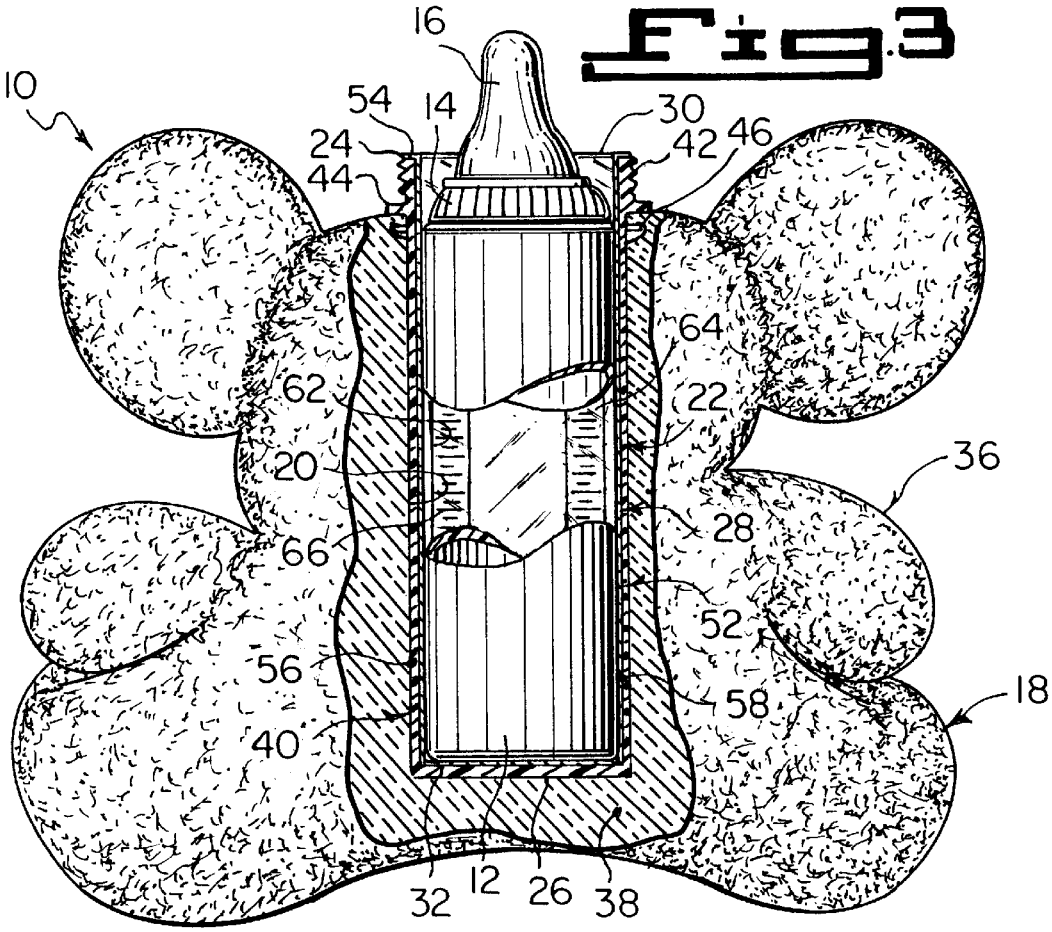
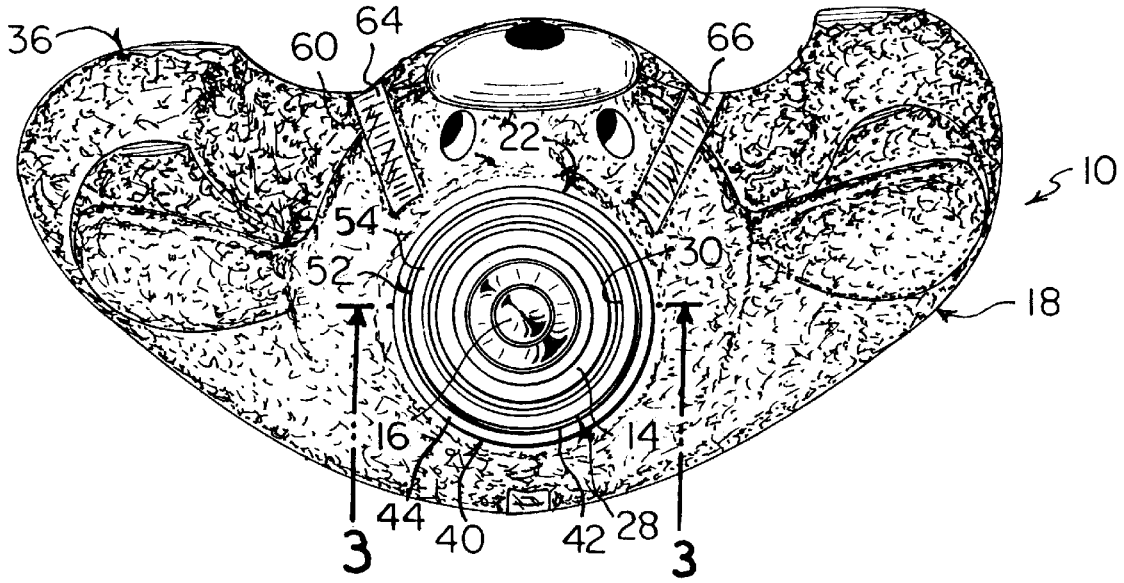
Fig. 2a

HOLDER FOR A BABY BOTTLE

BACKGROUND OF THE INVENTION

1. Field of the Invention

The instant invention relates generally to bottle covers and more specifically it relates to a holder for a baby bottle. The holder for a baby bottle will protect the baby bottle from breakage and act as an insulation jacket for the beverage within the baby bottle.

2. Description of the Prior Art

Numerous bottle covers have been provided in prior art. For example, U.S. Pat. No. 2,409,820 to Zimmern; U.S. Pat. No. 2,522,381 to Kramer; U.S. Pat. No. Des. 314,432 to Shaw and U.S. Pat. No. Des. 340,991 to Clements all are illustrative of such prior art. While these units may be suitable for the particular purpose to which they address, they would not be as suitable for the purposes of the present invention as heretofore described.

ZIMMERN, BENNO

BOTTLE COVER

U.S. Pat. No. 2,409,820

A nursing bottle holder comprising two padded sections, each having top, bottom and lateral edges constituting the periphery thereof. Each of the sections has front and back portions joined together at the periphery. Flexible hinge means joins the bottom edges of the two sections with the remainder of the edges free. One of the two sections may be rotated through an arc of approximately 360 degrees about the flexible hinge means to expose either the front or back portions of the sections. Securing means comprises a tape attached only to a lateral edge of one of the sections adjacent to the top edge thereof. The tape has a length to encircle the sections with a nursing bottle positioned therebetween, and a means detachably secures the ends of the tape together.

KRAMER, WILLIAM

TEMPERATURE RETAINING COVER FOR BABY BOTTLES AND OTHER RECEPTACLES

U.S. Pat. No. 2,522,381

A hood for use with a baby bottle having a nipple, comprising an insulated tubular casing having open top and bottom ends for enclosing the bottle from a point slightly below the top thereof to the bottom thereof. A draw string at the open bottom of the tubular casing is for closing the open bottom of the tubular casing about the bottom of the bottle. Superimposed discs of waterproof material formed with concentric aligned openings extend across the top of the bottle with the nipple extending through the aligned openings. The discs have their peripheral edges bent downward along the sides of the top portion of the bottle and stitched to the material of the tubular casing about the open top end thereof. The discs have the edge portions thereof surrounding the concentric openings bent inward and outward between the adjacent faces of the discs. A line of stitches passed through the discs and the edge portions securing the edge portions in position between the adjacent faces of the discs.

SHAW, LISA

BABY BOTTLE HOLDER

U.S. Pat. No. Des. 314,432

The ornamental design for a baby bottle holder, as shown and described.

FIG. 3 is a side elevational view thereof, opposite that shown in FIG. 2.

FIG. 6 is a rear elevational view thereof.

FIG. 7 is a front elevational view thereof.

The broken line showing of the bottle in FIGS. 1–5 and 7 is for illustrative purposes only and forms no part of the claimed design.

CLEMENTS, TONI R.

BABY BOTTLE HOLDER

U.S. Pat. No. Des. 340,991

The ornamental design for a baby bottle holder, as shown and described.

Figure 1:
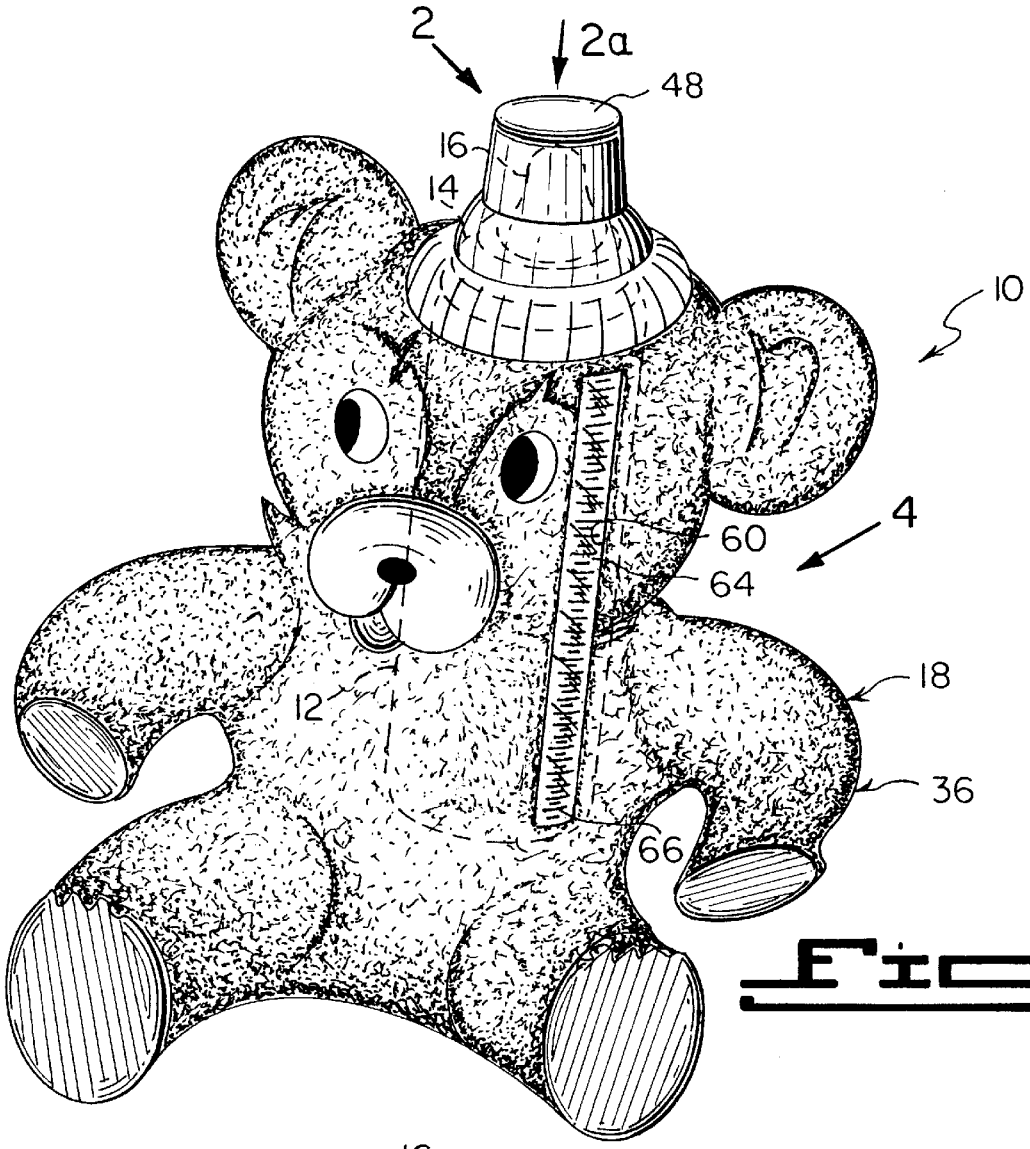
FIG. 1 is a perspective view of a baby bottle holder, showing the new design.

FIG. 1 is a perspective view of a baby bottle holder embodying the design of the present invention.

Figure 2:
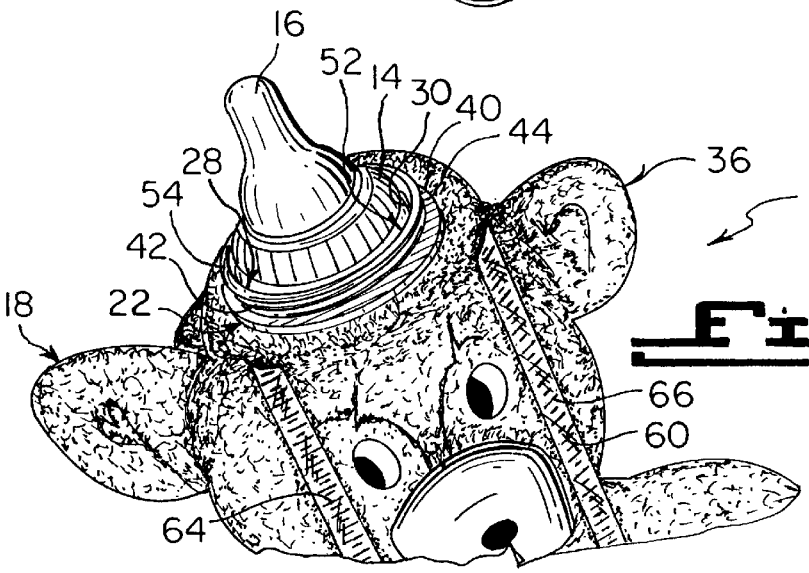
FIG. 2 is a side elevational view thereof.

FIG. 2 is a front elevational view thereof.

FIG. 3 is a rear elevational view thereof.

Figure 4:
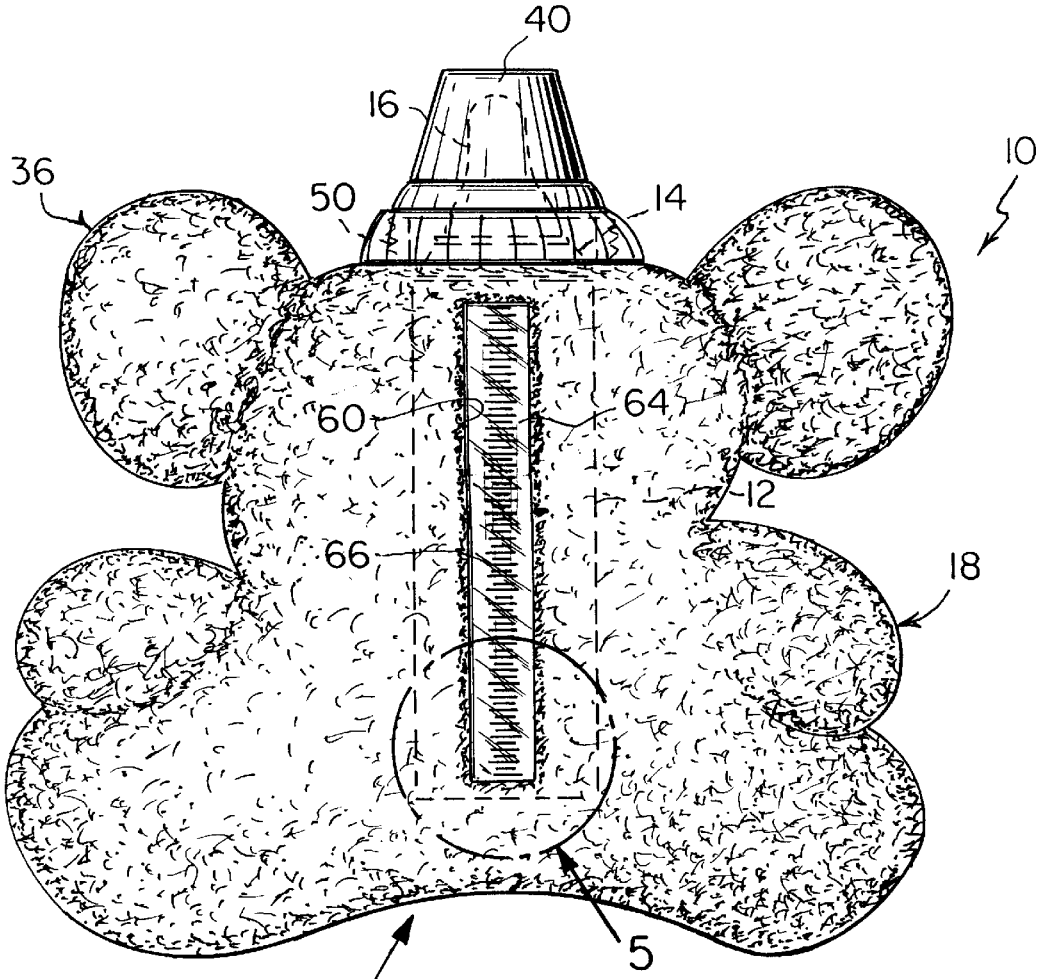
FIG. 4 is a top plan view thereof.

FIG. 4 is a side elevational view thereof.

Figure 5:
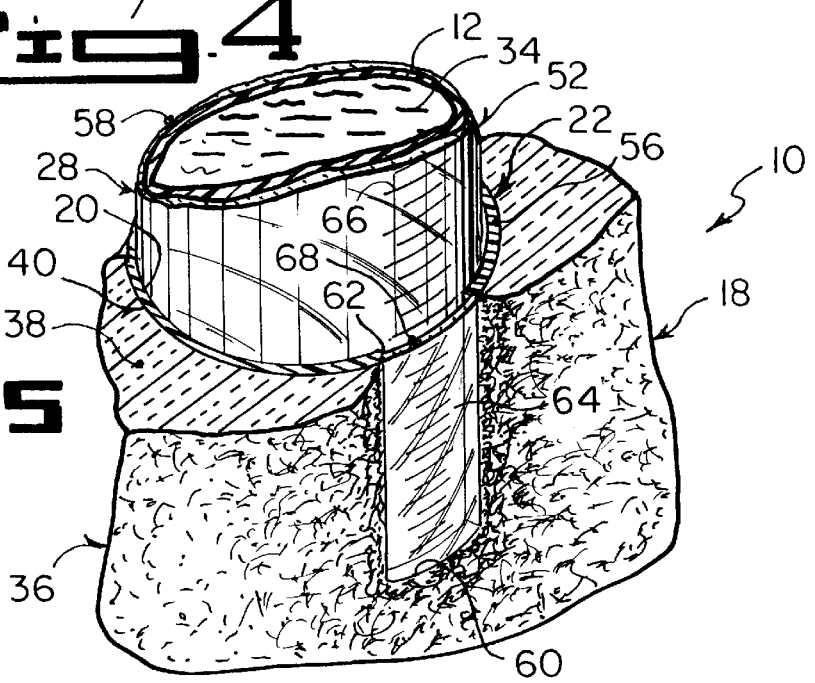
FIG. 5 is a bottom plan view thereof.

FIG. 5 is a side elevational view thereof.

FIG. 6 is a top plan view thereof.

FIG. 7 is a bottom view thereof.

SUMMARY OF THE INVENTION

A primary object of the present invention is to provide a holder for a baby bottle that will overcome the shortcomings of the prior art devices.

Another object is to provide a holder for a baby bottle that will protect the baby bottle from breakage and will act as an insulation jacket to keep the beverage within the baby bottle warm or cold.

An additional object is to provide a holder for a baby bottle that can be made into various ornamental shapes, so as to be attractive to a child.

A further object is to provide a holder for a baby bottle that is simple and easy to use.

A still further object is to provide a holder for a baby bottle that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 is a front perspective view of the present invention.

FIG. 2 is a top perspective view taken in the direction of arrow 2 in FIG. 1, with lower portion broken away and the nipple cap removed therefrom.

FIG. 2*a* is a top plan view taken in the direction of arrow 2*a* in FIG. 1 rotated one hundred and eighty degrees, with the nipple cap removed therefrom.

FIG. 3 is a rear elevational view partly in cross section as indicated by line 3—3 in FIG. 2*a*.

FIG. 4 is a rear elevational view taken in the direction of arrow 4 in FIG. 1.

FIG. 5 is an enlarged front perspective view of an area indicated by arrow 5 in FIG. 4, with parts shown in section.

Similar reference characters denote corresponding features consistently throughout the attached drawings.

DESCRIPTION OF THE PREFERRED EMBODIMENTS

Turning now descriptively to the drawings, in which similar reference characters denote similar elements throughout the several views, FIGS. 1 through 5 illustrate the present invention being a holder 10 for a baby bottle 12. With regard to the reference numerals used, the following numbering is used throughout the various drawing figures.

10 holder for 12
12 baby bottle
14 cap of 12
16 nipple of 12
18 insulation jacket of 10
20 central aperture in 20
22 outer sleeve of 10
24 open top end of 22
26 closed bottom end of 22
28 inner sleeve of 10
30 open top end of 28
32 closed bottom end of 28
34 beverage in 12
36 washable stuffed animal body for 18
38 soft padded material of 18
40 first cylindrical tube for 22
42 externally threaded neck on 40
44 annular collar on 40
46 pin on 40
48 nipple cover of 10
50 internally threaded mouth of 48
52 second cylindrical tube for 28
54 annular flange on 52
56 durable plastic material of 22
58 durable transparent plastic material of 28
60 elongated longitudinal slot in 18
62 elongated longitudinal opening in 22
64 window pane in 62
66 scale markings on 28
68 durable transparent plastic material of 64

The holder 10 is for the baby bottle 12 having a cap 14 with a nipple 16 extending therethrough. The holder 10 compromises an insulation jacket 18 having a central aperture 20 extending vertically therein. An outer sleeve 22 has an open top end 24 and closed bottom end 26 held within the central aperture 20. An inner sleeve 28 has an open top end 30 and a closed bottom end 32 held within the outer sleeve 22, receive the baby bottle 12 therein, with the nipple 16 extending out therefrom. The insulation jacket 18 will protect the baby bottle 12 from breakage and will keep a beverage 34 within the baby bottle 12 at a desired temperature.

The insulation jacket 18 is a washable stuffed animal body 36. The insulation jacket 18 is fabricated out of a soft padded material 38.

The outer sleeve 22 consists of a first cylindrical tube 40 having an externally threaded neck 42 at the open top end 24 and an annular collar 44 formed below and extending from the externally threaded neck 42. A plurality of pins 46 are radially positioned about the first cylindrical tube 40 and are slightly spaced below the annular collar 44. The annular collar 44 and the pins 46 will maintain the first cylindrical tube 40 within the central aperture 20 of the insulation jacket 18. A nipple cover 48 has an internally threaded mouth 50, which will engage with the externally threaded neck 42 of the first cylindrical tube 40 over the nipple 16 of the baby bottle 12.

The inner sleeve 28 is a second cylindrical tube 52, having an annular flange 54 formed on the open top end 30. The second cylindrical tube 52 being slightly smaller in diameter than the first cylindrical tube 40, will snugly fit therein with the annular flange 54 on top of the open top end 30 of the first cylindrical tube 40. The outer sleeve 22 is fabricated out of a durable plastic material 56. The inner sleeve 28 is fabricated out of a durable transparent plastic material 58.

The insulation jacket 18 has a plurality of elongated longitudinal slots 60 extending into the central aperture 20. The outer sleeve 22 has a plurality of elongated longitudinal openings 62 in alignment with the elongated longitudinal slots 60 in the insulation jacket 18. A plurality of window panes 64 are provided. Each window pane 64 is carried within one elongated longitudinal opening 62 in the outer sleeve 22. A plurality of scale markings 66 are carried on the inner sleeve 28 which are in alignment with the window panes 64, so that a person can visually see through any window pane 64 the amount of beverage 34 left within the baby bottle 12. Each window pane 64 is fabricated out of a durable transparent plastic material 68.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A holder for a baby bottle having a cap with a nipple extending therethrough, said holder comprising:

a) an insulation jacket having a central aperture extending vertically therein;

b) an outer sleeve having an open top end, a closed bottom end held within said central aperture, a first cylindrical tube having an externally threaded neck at said open top end and an annular collar formed below and extending from said externally threaded neck; and a plurality of pins radially positioned about said first cylindrical tube and slightly spaced below said annular collar, so that said annular collar and said pins will maintain said first cylindrical tube within said central aperture of said insulation jacket; and c) an inner sleeve having an open top end and a closed bottom end held within said outer sleeve, to receive the baby bottle therein, with the nipple extending out therefrom, whereby said insulation jacket will protect the baby bottle from breakage and will keep a beverage within the baby bottle at a desired temperature.

2. A holder for a baby bottle as recited in claim 1, wherein said insulation jacket is a washable stuffed animal body.

3. A holder for a baby bottle as recited in claim 1, wherein said insulation jacket is fabricated out of a soft padded material.

4. A holder for a baby bottle as recited in claim 1, wherein said inner sleeve is fabricated out of a durable transparent plastic material.

5. A holder for a baby bottle as recited in claim 1, further including a nipple cover having an internally threaded mouth, which will engage with said externally threaded neck of said first cylindrical tube over the nipple of the baby bottle.

6. A holder for a baby bottle as recited in claim 1, wherein said inner sleeve is a second cylindrical tube, having an annular flange formed on said open top end, whereby said second cylindrical tube being slightly smaller in diameter than said first cylindrical tube will snugly fit therein with said annular flange on top of said open top end of said first cylindrical tube.

7. A holder for a baby bottle as recited in claim 1, wherein said outer sleeve is fabricated out of a durable plastic material.

8. A holder for a baby bottle as recited in claim 4, further including:

a) said insulation jacket having a plurality of elongated longitudinal slots extending into said central aperture;

b) said outer sleeve having a plurality of elongated longitudinal openings in alignment with said elongated longitudinal slots in said insulation jacket;

c) a plurality of window panes, wherein each said window pane is carried within one said elongated longitudinal opening in said outer sleeve; and d) a plurality of scale markings, carried on said inner sleeve which are in alignment with said window panes, so that a person can visually see through any said window pane the amount of beverage left within the baby bottle.

9. A holder for a baby bottle as recited in claim 8, wherein each said window pane is fabricated out of a durable transparent plastic material.

10. A holder for a baby bottle as recited in claim 1, wherein said insulation jacket is fabricated out of a soft padded material.

11. A holder for a baby bottle as recited in claim 10 wherein said outer sleeve includes:

a) a first cylindrical tube having an externally threaded neck at said open top end and an annular collar formed below and extending from said externally threaded neck; and b) a plurality of pins radially positioned about said first cylindrical tube and slightly spaced below said annular collar, so that said annular collar and said pins will maintain said first cylindrical tube within said central aperture of said insulation jacket.

12. A holder for a baby bottle as recited in claim 11, further including a nipple cover having an internally threaded mouth, which will engage with said externally threaded neck of said first cylindrical tube over the nipple of the baby bottle.

13. A holder for a baby bottle as recited in claim 12, wherein said inner sleeve is a second cylindrical tube, having an annular flange formed on said open top end, whereby said second cylindrical tube being slightly smaller in diameter than said first cylindrical tube will snugly fit therein with said annular flange on top of said open top end of said first cylindrical tube.

14. A holder for a baby bottle as recited in claim 13, wherein said outer sleeve is fabricated out of a durable plastic material.

15. A holder for a baby bottle as recited in claim 14 wherein said inner sleeve is fabricated out of a durable transparent plastic material.

16. A holder for a baby bottle as recited in claim 15, further including:

a) said insulation jacket having a plurality of elongated longitudinal slots extending into said central aperture;

b) said outer sleeve having a plurality of elongated longitudinal openings in alignment with said elongated longitudinal slots in said insulation jacket;

c) a plurality of window panes, wherein each said window pane is carried within one said elongated longitudinal opening in said outer sleeve; and d) a plurality of scale markings, carried on said inner sleeve which are in alignment with said window panes, so that a person can visually see through any said window pane the amount of beverage left within the baby bottle.

17. A holder for a baby bottle as recited in claim 16, wherein each said window pane is fabricated out of a durable transparent plastic material.

* * * * *